US006151848A

United States Patent [19]

Hunter

[11] Patent Number: 6,151,848

[45] Date of Patent: Nov. 28, 2000

[54] COMBINATION ACCESS DOOR ASSEMBLY AND UNITARY FRAME

[76] Inventor: Al Hunter, 9800 Chandler Dr., Raleigh, N.C. 27615

[21] Appl. No.: 09/228,518

[22] Filed: Jan. 11, 1999

[51] Int. Cl.[7] ..... E04B 5/52

[52] U.S. Cl. ..... 52/205; 52/19; 52/745.19; 52/745.15; 52/745.16; 29/897; 29/897.32; 83/23; 83/25

[58] Field of Search ..... 52/745.15, 745.16, 52/745.19, 745.2, 19, 206; 29/897, 897.3, 897.312, 897.32; 83/23, 25

[56] References Cited

U.S. PATENT DOCUMENTS

| | | | |
|---|---|---|---|
| D. 374,486 | 10/1996 | Guin . | |
| 1,925,635 | 9/1933 | Hartley . | |
| 3,598,686 | 8/1971 | Clark . | |
| 4,619,086 | 10/1986 | Naka . | |
| 4,738,054 | 4/1988 | Muth et al. . | |
| 5,327,682 | 7/1994 | Holtz . | |
| 6,082,069 | 7/2000 | Chennaux | 52/745.19 |

*Primary Examiner*—Christopher T. Kent
*Assistant Examiner*—Dennis L. Dorsey
*Attorney, Agent, or Firm*—Mills Law Firm PLLC

[57] ABSTRACT

A method and apparatus for constructing an access door assembly for providing entry to a crawl space or other storage area within a building is disclosed. The present access door assembly is constructed from a single blank of material by accurately cutting a door panel from the blank and simultaneously creating a peripheral frame wherein the door panel is mounted. The kerf resulting from the cutting process provides a predetermined clearance between the door panel and peripheral frame to permit installation of hinges and latching hardware to ensure proper functioning of the completed door assembly. The method of the present invention significantly reduces the labor costs involved in installing an access door by the conventional process, which requires sizing of a door to a preexisting opening, mortising hinges, and mitering and fitting a finished molding about the access door.

12 Claims, 3 Drawing Sheets

COMBINATION ACCESS DOOR ASSEMBLY AND UNITARY FRAME

BACKGROUND OF INVENTION

1. Field of Invention

The present invention relates generally to access doors and, more particularly, to a method and apparatus for constructing an access door and frame from a single sheet of material.

So-called access doors for providing access to an attic space, crawl space, or storage space through a wall or ceiling are well known to those skilled in the art. Typically, the access door is mounted between joists and/or frame members in the building being framed by a finish molding about the peripheral edges of the door.

In many installations, the finish molding is mitered at the corner junctures of the finish molding resulting in a joint that has to be filled during the finishing process. This joint typically cracks open and separates due to settling and other stresses to the building structure requiring maintenance and painting.

Thus, the present invention has been developed to provide a combined access door and peripheral frame constructed from a single piece of material to eliminate the corner joints thereof.

2. Description of Related Prior Art

U.S. Pat. No. 5,327,682 to Claudia P. Holtz discloses an access panel having a removable door and recessed hinge. The panel is made of a molded plastic such as styrene polymer. The door is press-fit and is held in the frame by grooves in the frame which align with the resilient protuberances on the door panel. A hidden hinge, which allows the door to be hinged or removed from the frame, is provided. Although the peripheral frame does not require corner joints, the door and frame are not constructed of a single sheet of material in the manner of the present invention.

U.S. Pat. No. 4,738,054 to James C. Muth et al. discloses an access door assembly for a ceiling including a frame adapted to be attached to supports of the ceiling and mounted in a generally horizontal position, and a door which fits within and has one edge hingedly connected to the frame. However, this door assembly requires several structural members to construct the frame and also requires relatively complex hardware and moving parts to operate the door assembly.

U.S. Pat. No. 1,925,635 to Cyril J. Hartley discloses a manhole cover and frame being of triangular form and having pivots situated adjacent to two of its corners so that it can be easily raised from its frame about these pivots by the operator lifting the cover at or near its third corner. However, this invention differs significantly from the single piece construction of the present invention.

U.S. Pat. No. 4,619,086 to Hiromitsu Naka discloses a ceiling construction for buildings having a plurality of hinged main beams disposed in a predetermined space relationship; a plurality of flanged cross beams connected to the main beams in a predetermined space relationship at right angles to the main beams so as to form a ceiling framework; a ceiling wall mounted on the ceiling framework so as to form an access opening in a predetermined position; and an access door with a plurality of mounting devices for mounting the door within the access opening. However, this ceiling construction is a complex structure having numerous components required to frame the access opening wherein a separately constructed door is mounted.

U.S. Pat. No. 3,598,686 to John E. Clark discloses a wall panel for a building structure comprising of fiberglass outer shell and a frame assembly positioned within the shell. The frame assembly is fiberglassed into the shell and the frame assembly is welded to the supporting structure of the building. However, this invention requires a more complex construction than the present intention having a significant number of panel components in its assembly.

Finally, U.S. Pat. No. Des. 374,486 to Quinton M. Guin discloses an ornamental design for a combined door and frame for a crawl space opening as shown and described.

SUMMARY OF THE INVENTION

After much study of the above indicated problem, the present invention has been developed to provide a method and apparatus for constructing an access door and a peripheral frame from a single sheet of material. The present method and apparatus provides the manufacturer or builder with a simple technique for constructing an access door to a crawl space or other storage area from a single sheet of material or a thermoplastic casting.

In a basic method of the present invention, a sheet of material such as plywood or plastic is cut to the exterior dimensions of the peripheral frame of the door and, thereafter, the door is cut out about its peripheral edges using a saw or other machine tool such that the peripheral frame is a unitary construction requiring no mitered joints or butt joints at the corners thereof as in the conventional practice for constructing such access doors.

Thereafter, mounting hardware such as hinges and a door latch are provided to mount the door within the frame. This technique provides a practical and cost effective means of framing and mounting an access door which can be utilized in both residential and commercial buildings.

The present access door assembly can be provided in an array of sheet materials including but not limited to plywood, sheet plastics, metals, composite materials and other suitable materials.

The present access door assembly can be prefabricated in a variety of dimensions for standard residential and commercial installations.

From the above it is an object of the present invention to provide an access door assembly wherein an access door and a peripheral frame are constructed of a single sheet or blank of a suitable material.

Another object of the present invention is to provide a method for constructing an access door assembly from a single sheet of material.

Another object of the present invention is to provide an access door within a peripheral frame wherein the corner joints of the frame are eliminated.

Another object of the present invention is to provide an access door within a peripheral frame which can be fabricated in a time efficient and cost effective manner.

Other objects and advantages of the present invention will become apparent and obvious from a study of the following description and the accompanying drawings which are merely illustrative of such invention.

DETAILED DESCRIPTION OF THE PREFERRED EMBODIMENT

Figure 1:
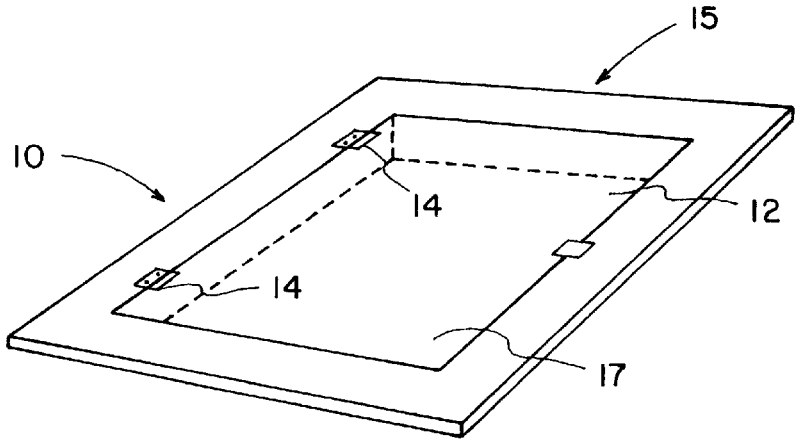
FIG. 1 is a perspective view of an access door assembly in accordance with the present invention.

With further reference to the drawings there is shown therein an access door assembly in accordance with the present invention illustrated in FIG. 1 and indicated generally at 10.

Figure 2:
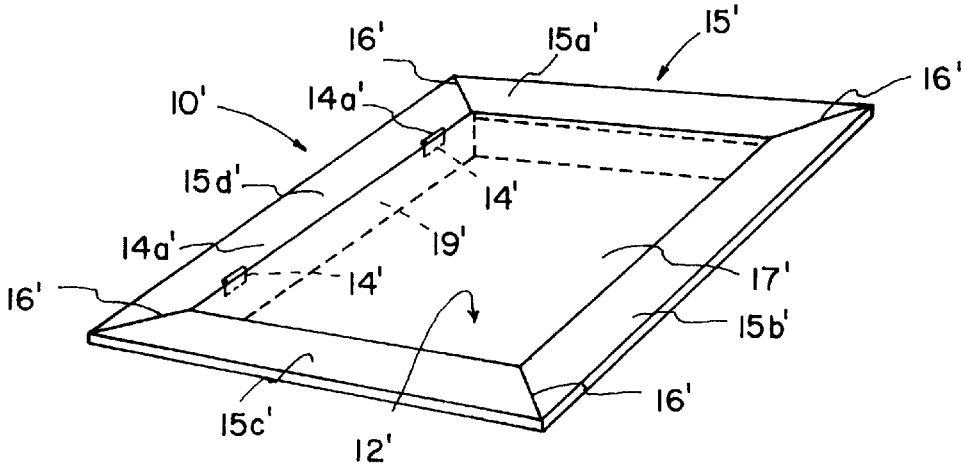
FIG. 2 is a perspective view of an access door frame of the prior art.

Prior to discussing the method and apparatus of the present invention, it may be beneficial to briefly review the structure and function of an access door assembly of the prior art, indicated generally at 10' as seen in FIG. 2. The access door assembly 10' of the prior art includes a door panel 12' mounted by hinges 14', which are typically mortised into a side wall 19' of the framed opening 17' such that one leaf of each hinge 14' is attached to the door panel 12' and the opposite leaf of the hinge is secured to the side wall 19'.

Figure 3:
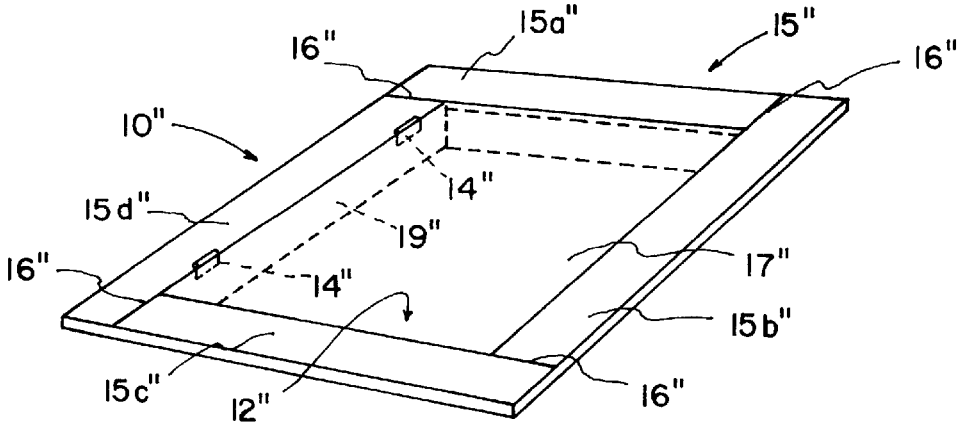
FIG. 3 is an alternative embodiment of an access door frame of the prior art.

Since such hinge installations illustrated in FIGS. 2 and 3 are well known to those skilled in the art, further detailed discussion of the same is not deemed necessary.

A peripheral frame indicated generally at 15' is constructed of a plurality of frame members 15*a'*, 15*b'*, 15*c'* and 15*d'*. In the conventional practice the individual frame members 15*a'*–15*d'* are installed about the outer edge of the door panel 12' after it is mounted within an opening 17' and being applied to the wall surface surrounding the opening 17' in the wall or ceiling wherein the door panel 12' is to be installed.

It will be noted by those skilled in the art that the individual frame members are joined at the corners thereof by the use of so-called mitered joints 16' wherein the terminal ends of each frame member 15*a'*, 15*b'*, 15*c'* and 15*d'* are cut at a 45° angle so as to form a square corner of the frame 15'.

Referring now to FIG. 3, there is shown therein an alternative construction of an access door assembly of the prior art, indicated generally at 10". In this configuration it can be seen that the individual frame members 15*a"*, 15*b"*, 15*c"* and 15*d"* are also joined at the corners thereof in a so-called butt joint 16" to complete the peripheral frame, indicated generally at 15".

In this arrangement as shown in FIG. 3 the door panel 12" is again installed in the access opening 17" and the individual frame members are thereafter installed about the peripheral edge of the door panel 12" on the wall surface to complete the installation.

The installation of the prior art access door assemblies 10' and 10" as illustrated in FIGS. 2 and 3 requires the skills of a finish carpenter and is a time consuming and labor intensive procedure. The mitered joints 16' and the butt joints 16" must be hand-fitted and any resulting gap along the joints 16' and 16" filled with a wood filler or caulking prior to hand sanding of the joint and thereafter finish painting. It is often the case that this process be completed in separate operations by a finish carpenter and then by a painter.

Further, in the conventional practice, the mitered joints 16' and/or the butt joints 16" are subject to cracking upon shifts in the building structure due to settling or other stresses on the building structure.

Referring again to FIG. 1, the access door assembly and method of its construction will now be described. The present access door assembly 10 includes a door panel 12 which is mounted by a pair of hinges 14 directly to a peripheral frame, indicated generally at 15 rather than within the opening 17 as in the prior art. It will be appreciated by those skilled in the art that frame 15 is of a unitary construction lacking the mitered joints 16' and/or the butt joints 16" of the prior art. In fact, it will be seen that both the door panel 12 and frame 15 are constructed from a single sheet of a suitable material or blank as described hereinafter in further detail.

Figure 4:
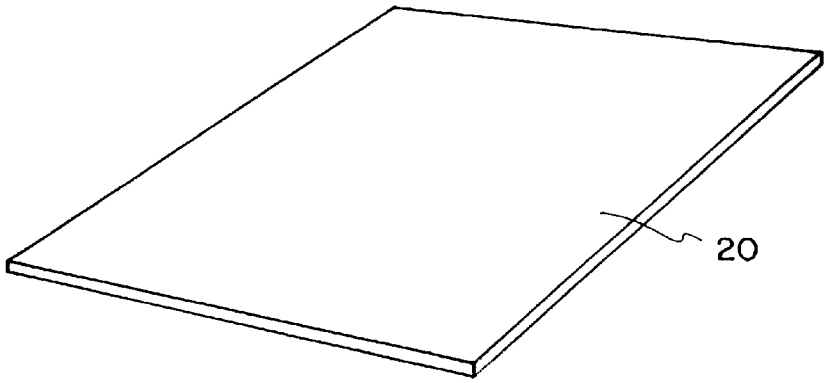
FIG. 4 is a perspective view of a blank of sheet material for use in constructing the present invention.

In accordance with the present invention the door access assembly 10 in its simplest form is constructed from a single rectangular blank 20 of a suitable material such as plywood, metals, composites, thermoplastics, polyvinyl chloride (PVC), etc. The blank 20 is cut to the finished dimensions of the outer periphery of the frame 15 as seen in FIG. 4.

Figure 5:
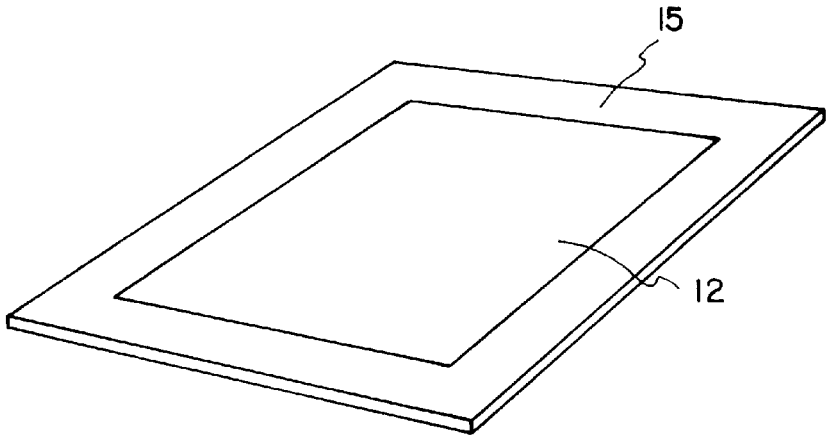
FIG. 5 is a perspective view of the blank of FIG. 4 showing the layout for the door panel.

Next, the door panel 12 is laid out on the blank 20 as shown in FIG. 5 and cut along the peripheral edges thereof to its finished dimension. This cutting procedure is accomplished by a power saw in the most basic method of the present invention. However, other machine tools such as a hand-controlled router or more sophisticated techniques utilizing numerical control (CNC) machining may be utilized to accurately duplicate a cutting process in separating the door 12 from the frame 15.

When using the thermoplastic materials, it will be understood that the door panel 12 and the peripheral frame 15 can be cast together as mating parts and separated prior to assembly.

Figure 6:
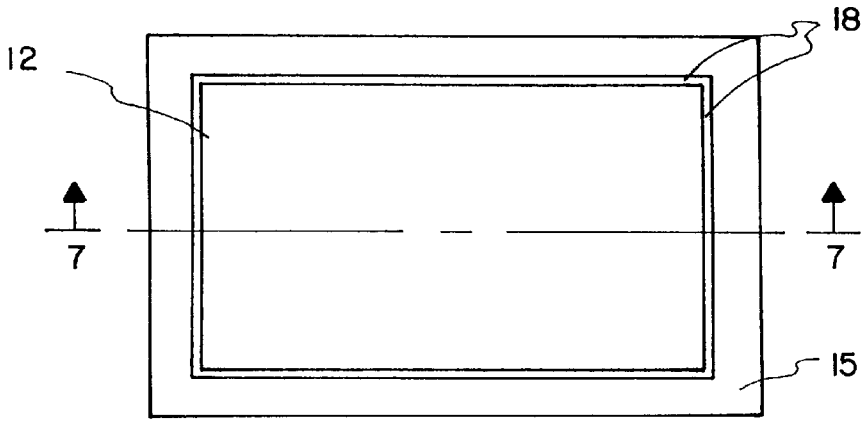
FIG. 6 is a top plan view of the door panel and the peripheral frame as separated components showing the resulting gap therebetween.

Critical to the present invention is providing an accurate and consistent kerf or gap as at 18 between the door panel 12 and the surrounding frame 15 as seen in FIG. 6. By maintaining a consistent gap 18 of a predetermined dimension, a significant advantage is gained during installation of the hinges 14 which requires that adequate clearance be maintained between the door 12 and the frame 15 to assure proper operation of the completed door assembly 10 as depicted in FIG. 1.

Figure 7:
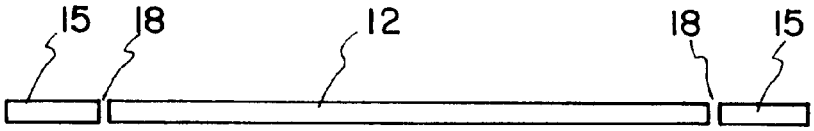
FIG. 7 is a sectional view taken along the line 7—7 of FIG. 6 showing the door panel and the peripheral frame components.

Referring now to FIG. 7 there is shown a cross-sectional view of the door panel 12 and the surrounding frame showing the gap or kerf 18 produced by the basic cutting method of the present invention.

Figure 8:
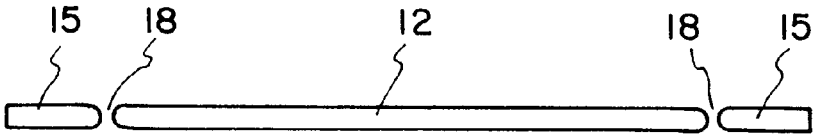
FIG. 8 is a sectional view taken through an alternative embodiment of the access door assembly after machining with a router bit producing radiused edges on the door panel and the peripheral frame.
Figure 9:
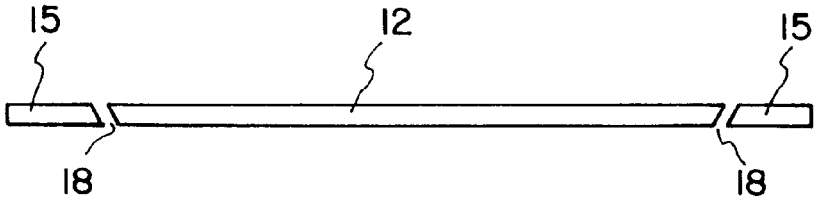
FIG. 9 is a sectional view of yet another alternative embodiment of the access door assembly showing the gap produced at an acute angle to the vertical.

It will be appreciated by those skilled in the art that variation in the finished edges of the frame 15 and the door panel 12 adjoining the clearance gap 18 may be achieved by the use of decorative router tool bits (not shown) as depicted in FIG. 8 or by varying the angle of the kerf 18 as shown in FIG. 9, which may be preferable in specific applications.

Figure 10:
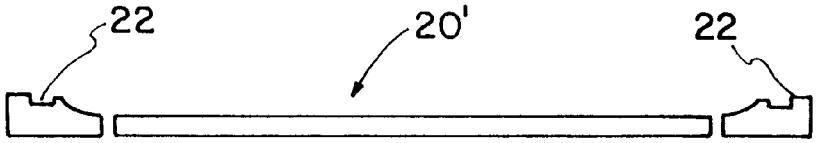
FIG. 10 is a sectional view of yet another alternative embodiment of the access door assembly produced from a thermoplastic blank including a raised relief molding integrated into the peripheral frame.

In addition, the present invention contemplates fabricating the present access door assembly from a blank 20' formed by a thermoplastic injection molding process so as to produce a peripheral frame having the appearance of a traditional sculpted molding as illustrated in FIG. 10. The cross-sectional profile as at 22 of this embodiment may be cast to form many different molding configurations to match moldings used for window sash, chair rails, etc. in residential construction.

Once the access door assembly 10 is constructed and assembled as described hereinabove, the completed assembly is installed as a unit over an access opening 17 as shown in FIG. 1 formed in a wall or ceiling to a predetermined dimension.

From the above it can be seen that the access door assembly of the present invention and the method of its construction and installation eliminates the labor intensive steps of the prior art required to install an access door in a wall or ceiling.

More particularly, the labor intensive steps of cutting and sizing an access door to fit a preexisting opening and, thereafter, cutting and fitting a peripheral molding about the conventional access door are eliminated by the use of the present invention. The terms "upper", "lower", "side" and so forth have been used herein merely for convenience to describe the present invention and its parts as oriented in the drawings. It is to be understood, however, that these terms are in no way limiting to the invention since such invention may obviously be disposed in different orientations when in use.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. A method of constructing an access door assembly including a door panel and a peripheral frame for installation adjacent to an opening to a storage area within a building, said method comprising steps of:

providing a blank of material of predetermined dimensions;

laying out a door panel and a peripheral frame on said blank;

fabricating said door panel such that a uniform gap is formed between said panel and said peripheral frame;

mounting said door panel in pivoting relation to said frame; and installing said access door assembly as a unitary construction in covering relation to said opening.

2. The method of claim 1 wherein the step of providing further includes the steps of:

forming a plurality of said blanks in different sizes; and finishing said blanks to the overall dimensions of said peripheral frame.

3. The method of claim 2 wherein said steps of forming and finishing are carried out by traditional woodworking tools and abrasives.

4. The method of claim 1 wherein the step of providing further includes the step of:

casting said blanks using a thermoplastic material.

5. The method of claim 4 wherein the step of casting is carried out by an injection molding machine.

6. The method of claim 1 wherein the step of laying-out further includes the steps of:

measuring the dimensions of said door panel; and scribing the peripheral outline of said door panel on said blank.

7. The method of claim 1 wherein said step of fabricating further includes the steps of:

programming a numerical control machine to trace the outline of said door panel; and machining said door panel from said blank.

8. The method of claim 7 wherein the step of machining includes the use of a router bit to form a decorative edge about said door panel and said peripheral frame.

9. The method of claim 1 wherein the step of mounting further includes the steps of:

positioning said door panel within said peripheral frame to achieve an even gap therebetween; and attaching a pair of hinges between said door panel and said frame such that said door panel is pivotable from an open to a closed position.

10. The method of claim 1 wherein the step of installing further includes the step of:

securing said door panel to said peripheral frame by use of a latching mechanism.

11. The method of claim 1 wherein the step of fabricating further includes the step of:

casting said door panel and said frame as separate, mating components.

12. The method of claim 11 wherein the step of casting is carried out by an injection molding machine.

* * * * *